US005165819A

United States Patent [19]

Bowman

[11] Patent Number: 5,165,819

[45] Date of Patent: Nov. 24, 1992

[54] MANHOLE COVER SUPPORT WITH FLANGE BORNE ON ITS OWN BASE

[76] Inventor: Harold M. Bowman, 18867 N. Valley Dr., Fairview Park, Ohio 44126

[21] Appl. No.: 744,948

[22] Filed: Aug. 14, 1991

Related U.S. Application Data

[63] Continuation-in-part of Ser. No. 579,828, Sep. 10, 1990, Pat. No. 5,051,022, which is a continuation-in-part of Ser. No. 362,077, Jun. 6, 1989, Pat. No. 4,969,770.

[51] Int. Cl.[5] ..... E02D 29/14

[52] U.S. Cl. ..... 404/26

[58] Field of Search ..... 404/25, 26

[56] References Cited

U.S. PATENT DOCUMENTS 3,218,943 11/1965 Bowman .
3,218,944 11/1965 Bowman .
3,930,739 1/1976 Larsson ..... 404/26
4,969,770 11/1990 Bowman .
4,969,771 11/1990 Bowman .
5,021,261 6/1991 Bowman .

*Primary Examiner*—Ramon S. Britts
*Assistant Examiner*—N. Connolly
*Attorney, Agent, or Firm*—Watts, Hoffmann, Fisher & Heinke Co.

[57] ABSTRACT

A manhole cover support with a fixed-sized top flange is shown. The cover support is adaptable to standardizing on the manhole cover size and inventory of covers for group of manhole installations having geometrically similar but somewhat varying sizes, this as well as being useful for holding the cover level or inclined, at a new, higher grades while also permitting the efficient establishment of the new cover height elevation and adjustment of the same. The cover support comprises a top peripheral flange having a seat for a manhole cover and a cover keeper that rises from the outer periphery of the seat, and a base fitting into the confines of the cover keeper of an existing manhole cover-receiving structure such as a manhole frame, the base supporting the flange, and being in a slidable engagement therewith.

20 Claims, 5 Drawing Sheets

MANHOLE COVER SUPPORT WITH FLANGE BORNE ON ITS OWN BASE

REFERENCE TO OTHER APPLICATIONS

This patent application is a continuation-in-part of applicant's U.S. patent application Ser. No. 07/579,828, filed Sep. 10, 1990, now U.S. Pat. No. 5,051,022 which in turn was a continuation-in-part of applicant's U.S. patent application Ser. No. 07/362,077, filed Jun. 6, 1989, now U.S. Pat. No. 4,969,770.

It is also related to applicant's U.S. patent application Ser. No. 07/670,710, filed Mar. 18, 1991, and his U.S. Pat. Nos. 4,969,771 and 5,021,261.

BACKGROUND OF THE INVENTION

This invention relates to manhole cover supports for emplacing over and raising the grade of an existing manhole cover-receiving structure in a roadway, particularly to such supports that can be used to accommodate a group of manhole covers of a standard size and shape where the frames thereunder diverge somewhat as to the size of the otherwise geometrically similar covers that they can take.

For simplicity the term "existing manhole cover-receiving structure" is used here to refer to the existing, i.e., fixed in-place frame or other seating receptacle for a removable cover or grating that covers an access hole (i.e., hand hole, tool hole, manhole, catch basin or the like). The term "manhole cover" is used to refer to the removable cover or grating over the access hole. The resulting assembly of a receiving structure and a manhole cover ordinarily is intended to bear vehicular traffic. The term "manhole cover support" or simply "cover support" here means a structure that fits over the existing manhole cover-receiving structure, raises its grade, and thereby accommodates a cover or grating at its new elevated grade. The access hole covered is a utility enclosure serving, e.g., an electric, gas, water, sewer or storm drainage system.

The preponderance of manholes are circular (in street plan), have circular covers and have existing cover-receiving structures such as frames that are circular with circular cover keepers (also sometimes called "collars" or "riser rings"). Accordingly, much of this specification is directed to round manhole cover supports that have ring-like annular elements which are to interact with an existing round manhole cover-receiving structure. However, it should be understood that this invention can be utilized in connection with other shapes of cover support, e.g. rectangular, square, triangular, hexagonal and so on, and further that the instant cover support which is to be fitted to the usual circular hole of a frame can be adapted to take a round cover or one other than round, e.g. hexagonal, and even still further, this cover support need not have an outer periphery at pavement level that is round—that periphery can be, for example, square or octagonal.

Ordinarily a cover support finds its use when a roadway such as a street or highway is resurfaced with an added layer of paving material, typically asphalt concrete or sheet asphalt, to establish a higher grade. A principal use for the instant cover support is expected to be in a municipality where a group of manhole installations of somewhat varying diameters are likely to be encountered in the resurfacing. Thus, adjoining or the same subdivisions, boroughs, wards or districts may have existing manhole cover frames for accommodating a group of covers that are nominally of several fairly close sizes, say 22½ to 24 inches in diameter. When resurfacing in such an area, it may be decided to standardize on a single size 23-, 24- or 25-inch diameter cover for this group to reduce the inventory of covers, purchase them in larger lots, avoid potentially costly custom-built equipment or short manufacturing runs by a single or a limited few manufacturers, and certainly to eliminate the digging out, raising and resetting of the existing frames or other cover-receiving structures simply to accommodate their original variously-sized manhole covers. It then can be especially advantageous to mount the inventive cover supports atop these existing manhole cover frames for the standardization purpose.

Heretofore the typical installation of new manhole cover supports has seemingly been circumscribed by and restricted to the reuse of the old cover. The possible benefits of standardizing on a new cover size (and possibly shape) in place of a group of geometrically similar covers that vary a little in size from one to another or from one subgroup to another, then designing a new cover support expressly for the new standardized covers appears to have gone unrecognized; it does not seem to have been addressed at all by the art.

Like the related manhole cover supports whose fixed-sized top flanges are borne on the upper rim of a manhole frame or other existing manhole-receiving structure, the instant cover support offers the economies efficiency and simplicity of such standardization practice. However, elevations of the peripheral flange of the instant cover support well above the upper rim of a manhole frame or other existing manhole cover-receiving structure can be established with less bulk and greater simplicity than when using such related cover supports. Furthermore, some embodiments of the instant invention can be adjusted as to height comparatively rapidly and effectively by including an elevation selection feature that is not present in such related fixed-size top flange-type cover supports.

Frequently, also, the roadway where the cover support is to be installed has a distinct crown. If the manhole cover can be seated at an incline that approaches the incline toward the crown, or at least compensates for a substantial portion of such incline, the repaving will be smoother. The instant cover support lends itself to the providing of such seating (even if the seat needs to have a plurality of inclines for a cover that is not flat, as for one that is near the intersection of two high-crowned streets). This is because the top flange in the instant invention is one-piece (either assembled as with bolts from a plurality of pieces or one solid piece).

Prior art on manhole cover supports and manhole cover frames can be found in U.S. Pat. Nos. 4,963,053, 4,872,780, 4,867,601, 4,281,944, 4,236,358, 4,203,686, 3,968,600, 3,773,428, 4,225,266, 4,302,129, 4,097,171, 4,302,126, 3,891,337 and 1,987,502. The first eight of these are for inventions of the applicant.

Axle loads up to 18,182 kg. must be resisted by many of these cover supports as well as serious impact loads from vehicles and snow plows, a variety of temperature effects, steam leaks, spillage, etc., without permitting a hazardous dislocation of the cover support or its cover. Often it is desirable also to cushion the cover for resisting wear or reducing noise, and/or to seal the cover and its cover support against a substantial and possibly overloading infiltration of surface water, e.g., storm drainage that otherwise would enter a sanitary sewer system at various manhole locations.

The instant cover support can be made especially highly resistant to displacement and dislodgement in service. Thus, while it preferably incorporates structural or mechanical hold-down (anchoring) means to the existing manhole cover-receiving structure, such anchoring extensions being integral with the cover support or easily attached to it, the instant cover support also can be constructed to do a good job of holding in (being retained in the existing manhole cover-receiving structure, such as a frame, while in service) by friction alone.

BROAD STATEMENT OF THE INVENTION

In its broadest sense the instant manhole cover support is for raising the grade of an existing manhole cover-receiving structure that has a cover keeper, a typical such structure being a manhole frame permanently set in masonry. The instant cover support comprises:

a peripheral flange that is disposed for retaining a manhole cover at a level higher than it was in the existing manhole cover-receiving structure to which said cover support is to be fitted, the flange including a seat for a manhole cover and a cover keeper that rises from the outer periphery of the seat; and a base that fits within the confines of the keeper of the existing manhole cover-receiving structure, the base being in slidable engagement with and supporting said flange.

When the instant cover support is used for the manhole cover size standardizing purpose essentially as described hereinbefore, the outer periphery of the flange desirably is at least practically coextensive with the outer periphery of the largest of the existing manhole cover-receiving structures of a group whose grade is to be raised by the same size of support.

The seat of the flange may be level or inclined for holding the manhole cover correspondingly. The flange can be of one piece or comprise a plurality of connected sections. The flange, in some embodiments, can be raised to one of two or more new levels.

Preferably the base is made expandable as discussed below. The base usually is made tall enough to hold the bottom of the flange above the upper rim of the cover keeper of the existing cover-receiving structure such as a manhole frame. The outer periphery of the instant cover support flange may extend outward beyond such upper rim. This usually is desirable, but is not a necessity.

Confining the cover laterally in the top flange of the new cover support is a cover keeper or collar. It rises from the outer periphery of the seat in the top flange of the cover support. The keeper can constitute the outer limits of the peripheral flange for a larger manhole cover, or it can rise inboard of the outer edges of such flange for confining a somewhat smaller manhole cover. Thickness of the keeper wall also can help to determine the cover size. As indicated earlier, the shape of the flange a new cover support is independent of the original cover shape; it need not be of the same shape or size as the original.

The means for anchoring the peripheral flange to a fixed part of the existing manhole structure can include one or more of the following general types. One type is directly gripping; it includes a plurality of downwardly-reaching extensions that grip, i.e., which can be hooked or otherwise fastened directly to or under the sill of the existing cover-receiving structure or other fixed part of the manhole structure below that. Another type is staged gripping; it includes a base that is held securely within the confines of the keeper or collar of the existing manhole cover-receiving structure such as a manhole frame, and the peripheral flange is secured to that base. A preferred device for staged gripping includes an expandable base having at least one adjustable joint equipped with a spreader device capable of making the base fit tightly within the confines of the lateral keeper of the existing manhole cover-receiving structure, said base being engaged with the peripheral flange for precluding substantial vertical separation of flange from base. A preferred cover support includes staged gripping of this sort in addition to plural direct extensions of the base that hook or otherwise fasten to the sill of the manhole cover-receiving structure or other fixed part of the manhole structure below that level. These can be similar to the extensions described above for the flange. The existing manhole structure, such as the manhole cover frame and the manhole structure therebelow, such as the sidewalls or bottom.

BRIEF DESCRIPTION OF THE DRAWINGS

FIG. 3 is a plan view of one segment of the base (i.e., the base ring) of the same embodiment from which FIGS. 1 and 2 are taken;

DETAILED DESCRIPTION

Figure 1:
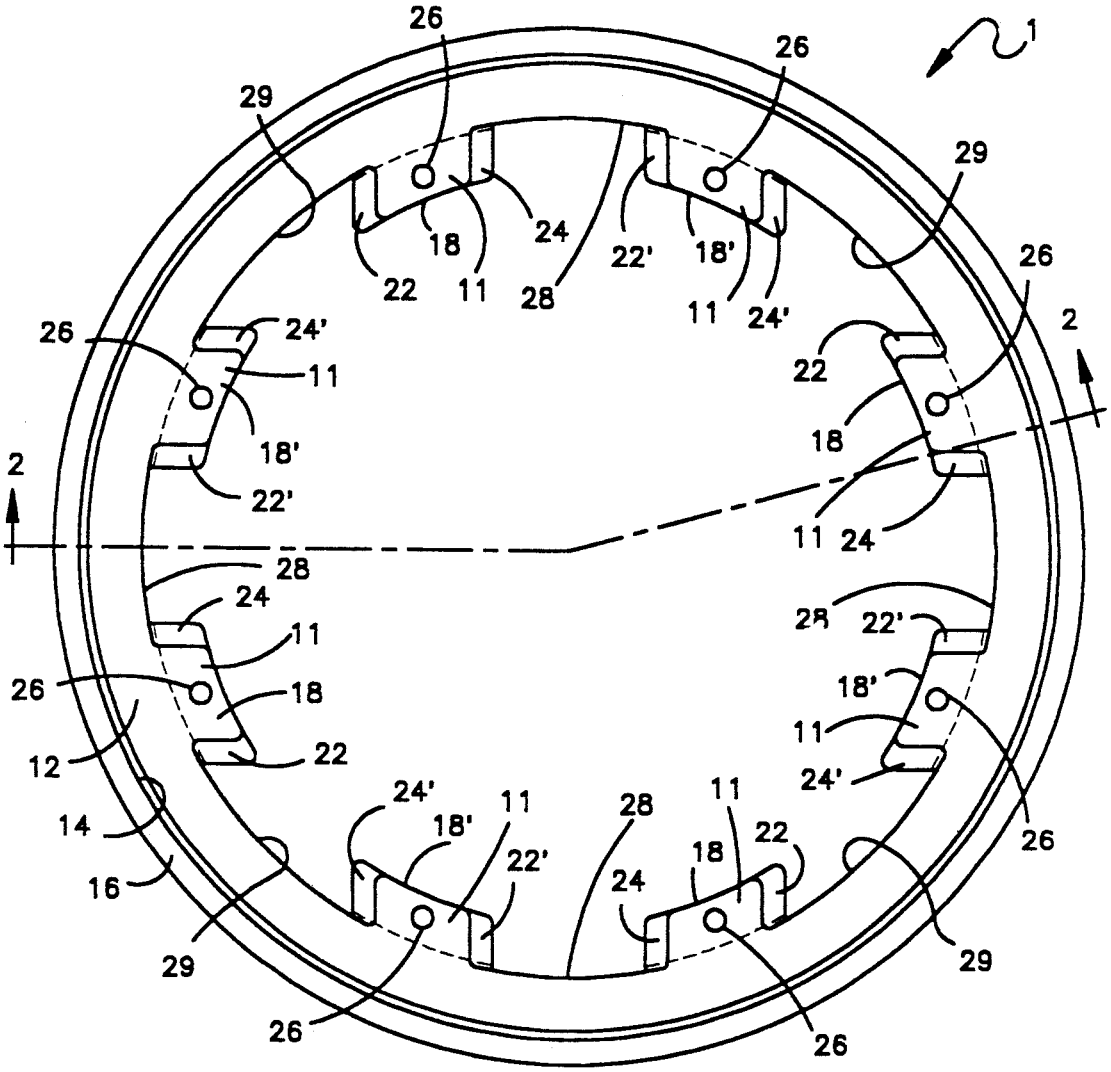
FIG. 1 is a top plan view of the cast iron peripheral flange (i.e., the top ring) of a preferred embodiment.

Reference is made to FIGS. 1–9. The arrows 1 of FIGS. 1 and 2 indicate generally the peripheral flange 1 (top ring) for a nominally 25-inch diameter manhole cover. The flange 1, with its annular, flat cover seat 12, flat bottom 13 directly below the seat 12, annular keeper 14, and keeper top 16, is made of cast ductile iron (ASTM type 536, Grade 60-45-12). The inner, almost vertical wall 14 of keeper 14 is 1.4 inches tall. It rises with a slight flair outward from the vertical. The flange can, of course, be waffled or ridged below the seat and/or on it, or otherwise partially hollowed out to lessen the flange weight.

Bracketing 270° in the flange 1 are a pair of lugs 18 and 18'. There are four pairs of these lugs 18 and 18' spaced evenly around the flange 12. As each pair is of generally identical construction, like reference numerals refer to like construction elements herein.

The tops 11 of lugs 18 and 18' are flush with seat 12. The sides 23 and respectively 23' of lugs 18 and 18', respectively, project almost vertically downward for the thickness of the seat 12, then flare or dove-tail out, as at slanting sides 22 and 24, and 22' and 24' below that for sliding into and engaging with slots 3 and 3' in the base ring, indicated generally by arrow 4 of FIG. 5. The outwardly and downwardly slanting sides 22 and 24 of the lug 18 and the corresponding slanting sides 22' and 24' of lug 18' bound the dove-tail parts of each lug pair. The pair of lugs 18 and 18' bracketing 270° on the flange 1 are parallel to each other and are directly opposite to the pair bracketing 90° on flange 1, and the pair bracketing 180° on flange 1 are parallel to each other and are directly opposite the pair bracketing at 360° on flange 1.

Figure 2:
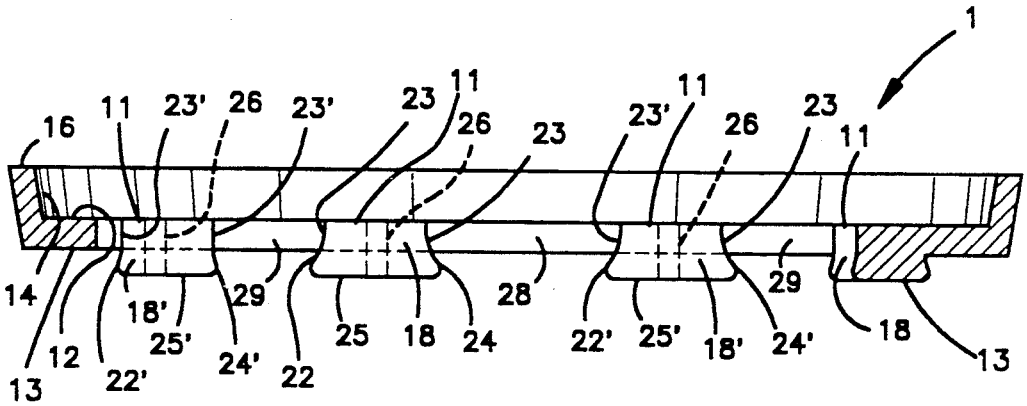
FIG. 2 is a cross-sectional elevation of the peripheral flange of FIG. 1 taken through the lines 2—2.
Figure 3:
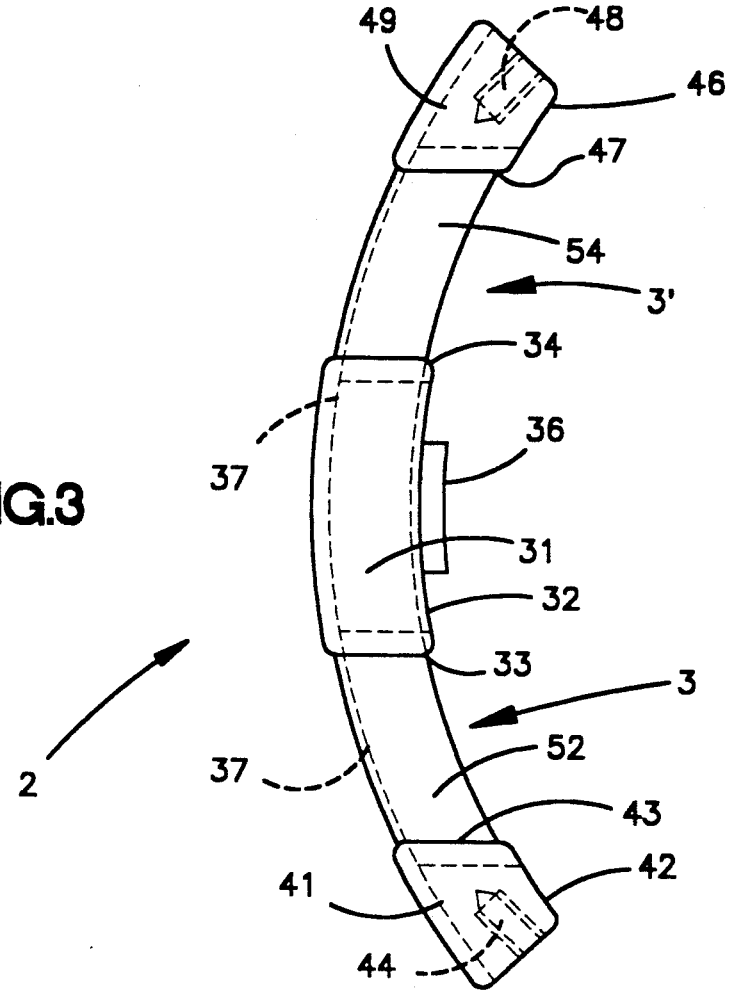
Figure 4:
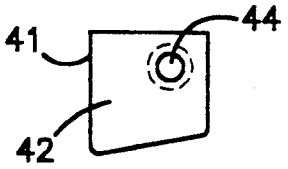
FIG. 4 is an end view of the lower end of the segment shown in FIG. 3.

In a preferred form, dove-tailed portion of a lug 18 and 18' has generally vertical parallel side surfaces, as at 23 and 23' of FIG. 2. These side surfaces merge into the lower slanted side surfaces or shoulders 22 and 24 on lug 18, and into shoulders 22' and 24' on a lug 18' to define a generally trapezoidal configuration in cross-section, as seen in FIG. 2. The side surfaces 23 and 23' extend downward nearly parallel to one another with respect to each pair of lugs. For example, in the embodiment illustrated in FIG. 1, there is illustrated the four pairs of lugs 18 and 18' such that the side surfaces 23 and 23' of each adjacent pair extend in the vertical and horizontal axis of the top ring 1. The slanted side surfaces or shoulders of lug 18, items 22 and 24, extend downwardly and outwardly (FIG. 2) and merge into a generally flat bottom surface, as at 25, which surface lies in a common horizontal plane below and generally parallel to the top surface of the seat 12 and the flange bottom 13. The vertical height of the side surfaces 23 is greater than the corresponding vertical thickness of the seat 12. The four central spaces between pairs of lugs 18 and 18' are almost rectangular in horizontal cross-section; each is bounded at the rear by the run 28 of the arcuate inner wall extending downwardly from the seat 12 and the vertical portions 23 and 23' of the lug walls directly facing each other. The four spaces intermediate to pairs of lugs 18 and 18' are almost trapezoidal in horizontal cross-section. Each is bounded at the rear by a longer run 29 of the arcuate inner wall extending downwardly from seat 12 and the vertical portions 23 and 23' of the lug walls.

Figure 5:
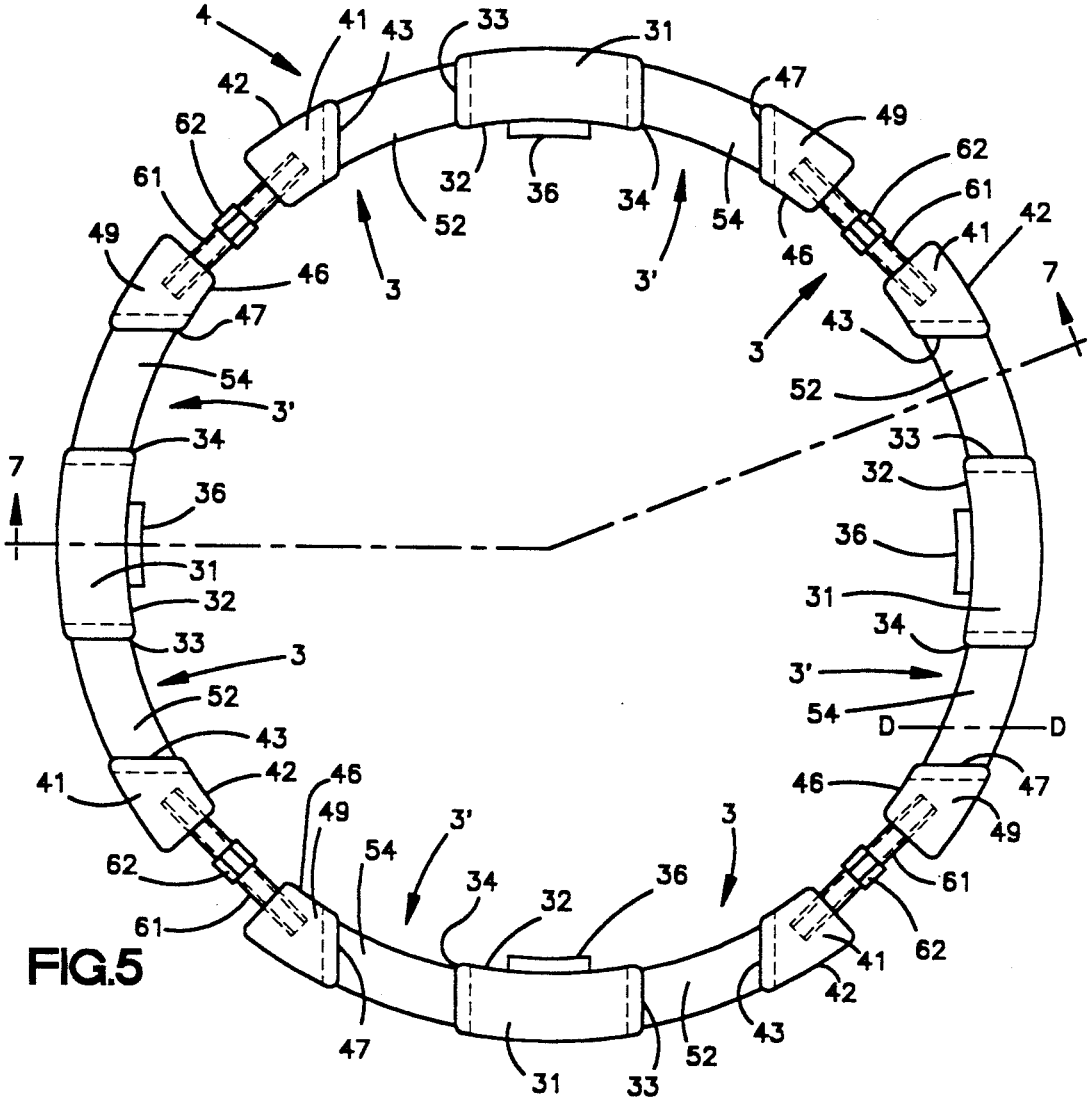
FIG. 5 is a top plan view of the cast iron base ring of the same embodiment.
Figure 7:
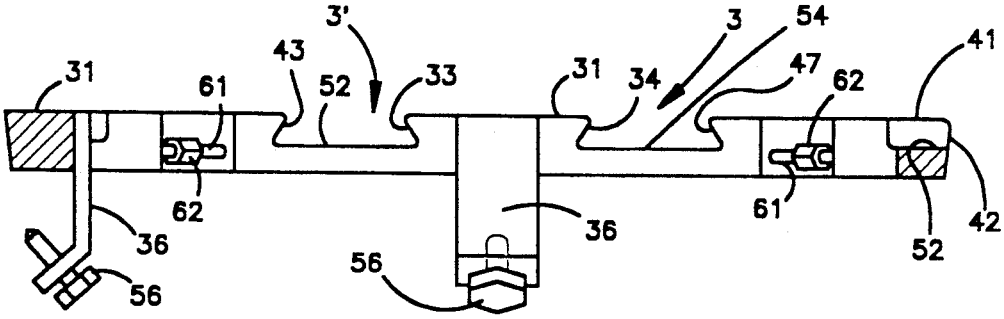
FIG. 7 is a cross-sectional elevation of the base ring of FIG. 5 taken through lines 7—7.
Figure 6:
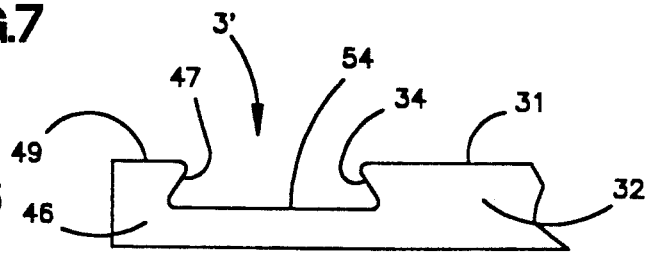
FIG. 6 is a fragmentary side elevation of the base ring of FIG. 5.

In the invention, while four pair of lugs (eight lugs in all) have been illustrated, it will be understood that the invention could be practiced with two pair of oppositely disposed lugs, although a greater number of symmetrically-disposed lugs are preferred so as to achieve a greater uniformity in the peripheral adjustment of the segmented base ring 4 of FIG. 5.

Centrally in the top of each lug is a tapped vertical hole 26 for a set screw (not shown) that in use will not project above the seat 12. The set screw will act as a separating lift to jam together the assembled peripheral flange and base, thus enabling the cover support to better resist vibration. Wedges also could be used for this. FIG. 2 shows the flat cover seat 12, inner wall of the keeper 14, keeper top 16, and lugs 18 and 18'.

The base (i.e., the base ring) of this cover support may be made in four like segments as described above with reference to FIGS. 3–7.

Figure 8:
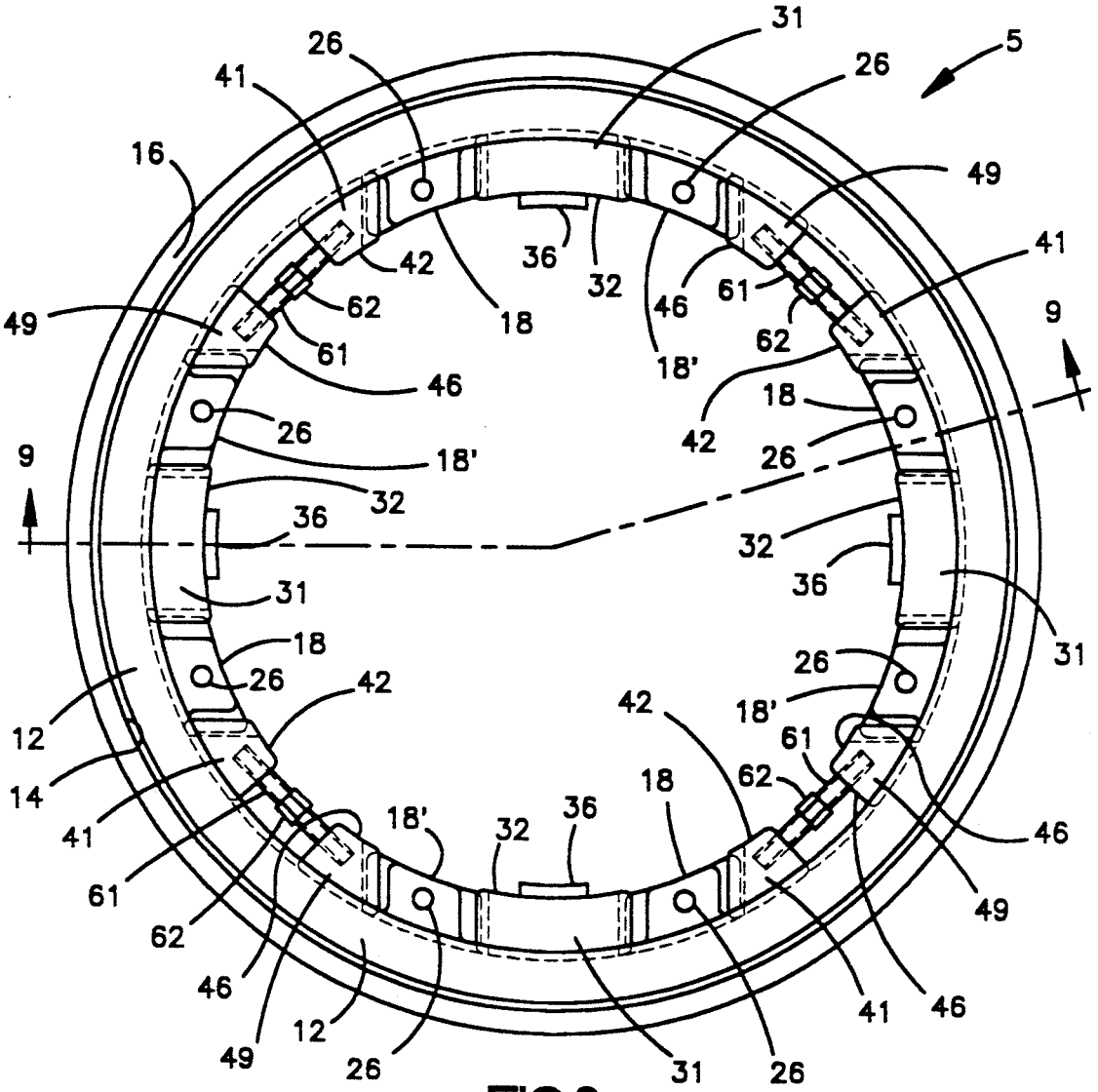
FIG. 8 is a plan view of the peripheral flange assembled with the base described with reference to FIGS. 3-7 wherein the lugs of the flange are engaged with the slots of the base. For simplicity, the polymeric frictional retention component bonded to parts of the structure are not shown in this FIG. 8, but is incorporated in FIG. 9 that follows.

In the plan view of FIG. 8, an assembly of the base 4, as described above with reference to FIGS. 3–7, preferably made of cast iron, more preferably cast ductile iron, and the peripheral flange of FIGS. 1 and 2 is indicated generally by arrow 5. Pairs of lugs 18 and 18', projecting downwardly from the flange with their tops flush with the flat cover seat 12, hold the flange from vertical parting from the base by fitting into the interfacing corresponding slots in the base below them. In the assembled condition, as shown in FIG. 8, it will be noted that the flange and the base are generally concentrically disposed relative to one another with the base being laterally inset relative to the keeper wall 14. In operation, the turning of the turnbuckle nut 62 in one direction draws the corresponding ends of the segments toward one another so as to cause the segments to move inwardly via a camming and sliding action between the corresponding slanted side surfaces of the corresponding lugs and slots, while actuation of the turnbuckle nut 62 in the opposite direction causes the segment ends to move away from one another. That causes the segments to move outwardly to press against the confining upper inner sidewalls of an existing manhole frame 78 (visible in FIG. 9). The assembly of FIG. 8 can be used with a nominally 22½- to 24-inch manhole frame, i.e., it fits a frame for a manhole of that nominal diameter. Once the base is tightly expanded and held down, set screws, not shown but slightly recessed in the holes 26 in the tops of the lugs, can be tightened to eliminate motion of the flange relative to the base.

Figure 9:
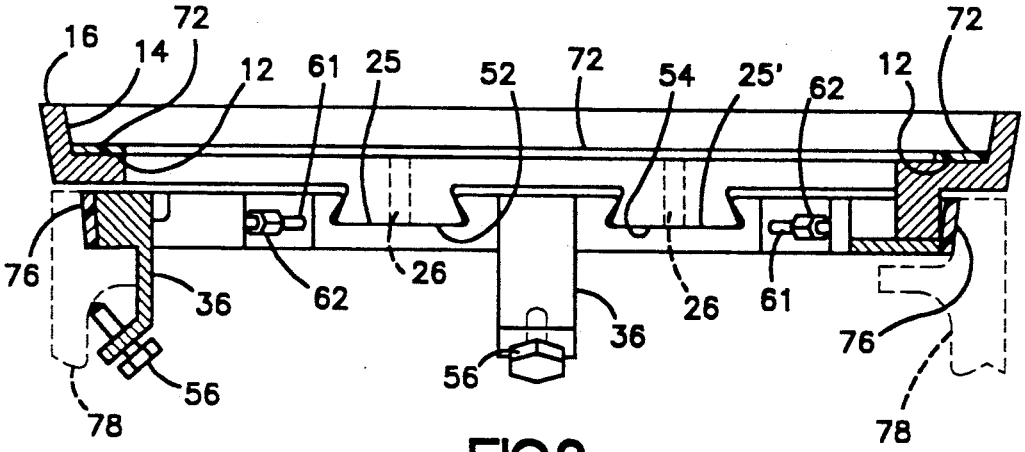
FIG. 9 is a cross-sectional elevation of the FIG. 8 assembly taken through the line 9—9 of FIG. 8.

FIG. 9 shows the fit of the generally trapezoidal-in-cross-sectional-elevation lug bottoms 25 and 25' of the flange into the broadly similarly-shaped slots in the base ring with their flared bottoms 52 and 54. Also evident in this view is the frictional retention component 76 bonded to the outside wall of each of the base segments 2. The retention component 76 is about 0.1 inch thick. It is interposed between the outer periphery of the base and the confining inner wall of the old cover keeper (collar) of the existing manhole cover frame 78 (the vertical cross-section of such frame being indicated in dotted lines). Expansion of the base presses this component 76, a slightly foamed elastomeric composition, slightly against inner wall of the old keeper (collar) of frame 78.

Resting on seat 12 and bonded thereto is a gasket 72 of like elastomer, about ⅛ inch thick, to help to seal against water leakage under the manhole cover and help silence said cover in use.

The hold-down grips 36 are clamped into place under the old cover seat (sill) of the frame 72 by the use of bolts 56.

While the preferred embodiment of the new cover support has its lugs facing down from the flange and its slots facing up from the expandable base, it should be understood that other arrangements are operable, e.g., with the lugs and slots vice-versa, or with some pairs of lugs on one of these ring-like elements and some on the other, say, in alternating fashion, and so on.

There best should be some play between the corresponding lugs and slots when the flange and base are assembled together, i.e., between the surfaces 22 and 43, 24 and 33, 22' and 34, and 24' and 47. This is to facilitate the necessary, but relatively limited expansion and contraction in response to operation of the spreaders (bolts 61, of the base to an effective diameter about ¾ of an inch up or down from that of the true circle, or about 3–4%. A main feature of the interfacing and slidably engaging slots with the corresponding lugs is to preclude a complete vertical parting of the flange from the base. The base, of course, desirably can be anchored to the existing manhole cover frame, as by anchoring grips. If desired, similar anchoring grips (not shown) can be used to secure the peripheral flange to the base, to the sill of the existing support, or to both places. Such grips can extend downwardly from the lugs 18 and/or 18' (FIG. 1) of the flange 1.

Even a modestly expanded or contracted split base ring of sheet steel is unlikely to remain truly circular in outer periphery. Were its adjusted resulting shape to remain even closer to a true circle than that made by a multi-segmented base, and that is unlikely, any fixed lugs or slots of such split ring still would be subject to some misalignment. Accordingly, a fair amount of play between corresponding lugs and slots, facilitating a sliding fit over a small, say, no more than about ±5% maximum effective diameter change, but with preclusion of complete vertical separation one from the other, is desirable. If the thickness of the moving one of these two elements, e.g., the metal around the slots in the base 4, is no more than about ½ inch, this is less restrictive to the sliding range of base-flange engagement than are thicker walls around such slot. The lugs and/or the slot wall elements could be made centrally pivotable with their bottoms and tops in essentially horizontal planes to permit more sliding range between them, but this is an added expense.

Figure 10:
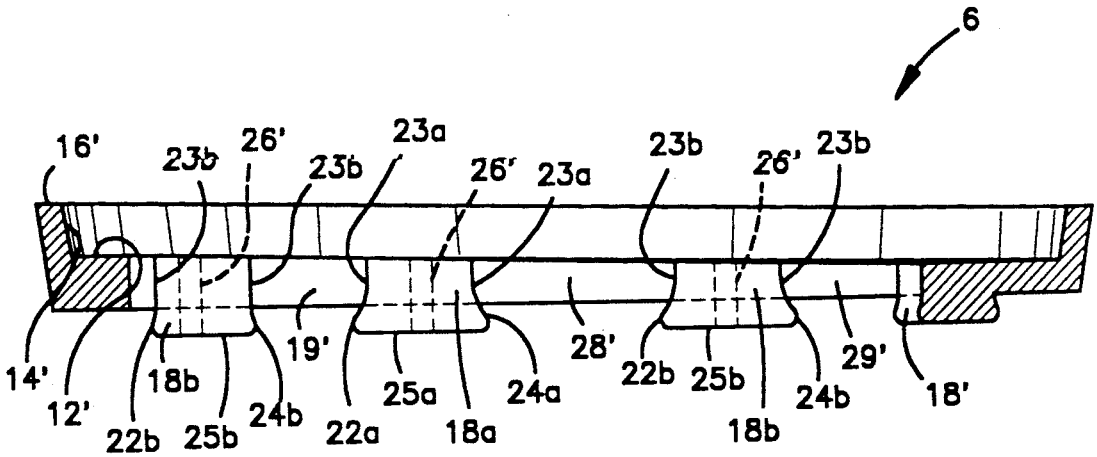
FIG. 10 is a cross-sectional elevation of a top flange like that of FIG. 2 except that it has an inclined cover seat. It is substitutable for the flat-seated flange of FIG. 2 which forms part of the assembly shown in FIG. 9.
Figure 11:
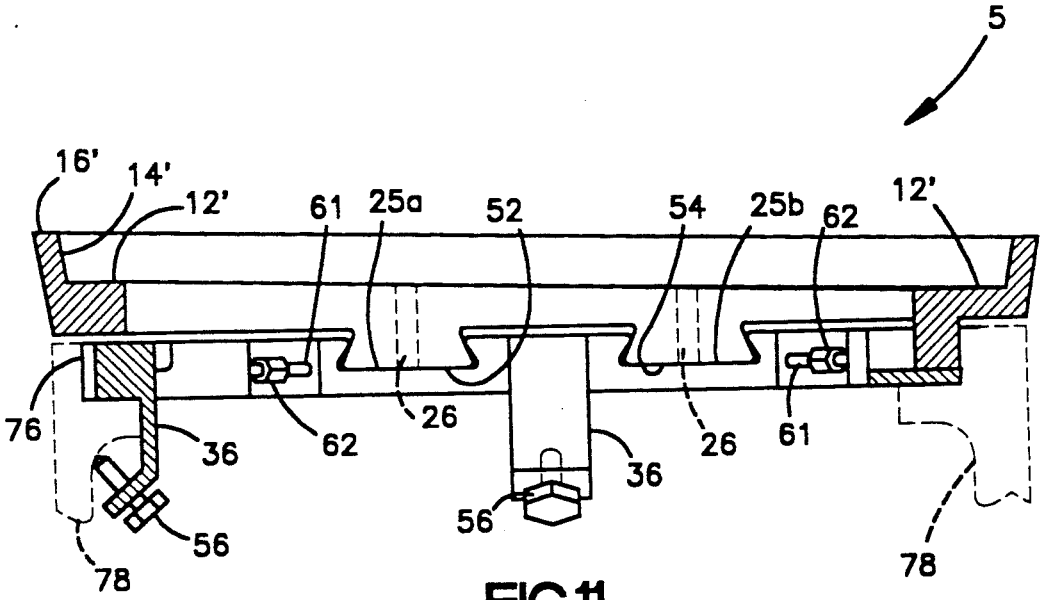
FIG. 11 is a vertical cross-section of the flange of FIG. 10 installed in a cover support assembly like that of FIG. 9 except that the cover seat now is inclined. All of the extensions can be hooked directly under the sill (cover seat) of an existing manhole frame to anchor the support to such frame.

Reference is now made to FIGS. 10 and 11 of the drawings.

FIG. 10 shows a top flange, indicated broadly by arrow 6, this flange having an inclined seat 12'. It can be installed with its high side in the direction of a high area of a roadway such as a crown. The reference numbers used in FIG. 10 correspond to those in FIG. 2 with these modifications: plain digits, unpaired with a primed like digit, of flange 1 in FIG. 2 are primed in the flange 6 of FIG. 10 to indicate a corresponding feature of the flange 6 in FIG. 10; plain digits that are paired with primed digits of the flange 1 features in FIG. 2 are given a subscript "a" to denote a corresponding feature of flange 6 in FIG. 10; and primed digits that are paired with plain digits for the flange 1 features of FIG. 2 are given the subscript "b" to denote a corresponding feature of the flange 6 in FIG. 10.

One can substitute flange 6 of FIG. 10 for flange 1 of FIG. 2 into a manhole cover support assembly to get a cover support which, in a vertical crosssection, looks like the cover support (indicated broadly by arrow 7) of FIG. 11 instead of the cover support 5 of FIG. 9. The seat 12 of flange 1 is not inclined with respect to the bottom of a manhole cover; the seat 12' of flange 6 is inclined, and FIG. 11 indicates that.

Figure 12:
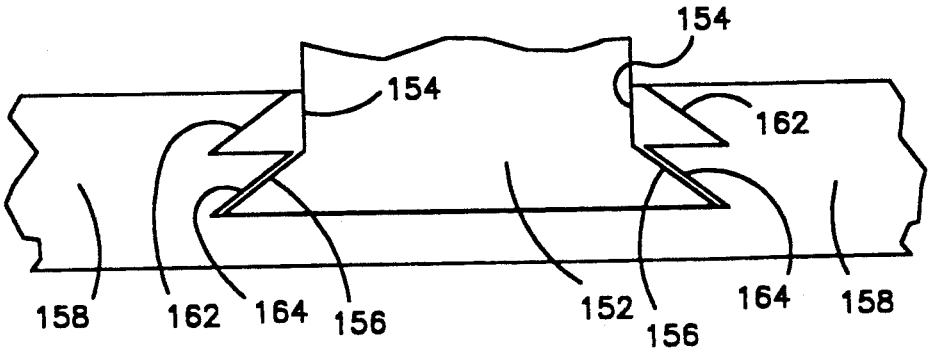
FIG. 12 shows a fragmentary and schematic representation of an alternative type of cooperating trapezoidal connectors for elevation adjustment of peripheral flanges, which flanges are supported by the base ring into which they fit. This type of connector could be used in place of those shown and described in connection with FIGS. 1-11.

Reference is now made to FIG. 12 where a provision for height adjustment is desired in the top flange and the lugs 152 (related broadly to the lugs 18 and 18' in the flange 1 of FIGS. 1, 2, 8 and 9 and to the lugs **18*a* and 18*b* in FIGS. 10 and 11) have extended vertical portions 154 coming down from the peripheral flange above (such flange not shown). These elongated lugs terminate in base-down trapezoidal shoulders 156 which can be fitted into either of the correspondingly set of base-down trapezoidal slots represented by items 162 and 164 of a base ring 158. (The stacked slots 162 and 164 are related broadly to the single set of slots 52 and 54 in the base ring of FIGS. 3, 5, 6, 7, 9 and 11, except that the base ring 158 is double-decked rather than single-decked with respect to such stacked trapezoidal slots.) Otherwise, the assembled apparatus may be made like the apparatus 5 of FIG. 9 (flat seat) or FIG. 10** (inclined seat) for the manhole cover; either such apparatus has a segmented base expandable by turnbuckles at the several joints.

Suitable frictional components and sealants for this service usually are flexible polymers, often elastomeric. Advantageously they can self-adhere or be adhered to most kinds of surfaces, e.g., with a cement, and advantageously also they can be expanded into a dense, closed cell foam.

Suitable polymers that can be formulated for use in the compressible retention component and the water seals herein include cork and cork-filled flexible sheeting, natural and synthetic rubbers, water-resistant ionomers, various vinyl polymers and copolymers such as polyvinyl acetate-polyethylene-acrylate copolymers and polyvinyl chloride homopolymers, plastisols such as a vinyl plastisol, polyurethanes, polyester resins, epoxy resins, styrene-containing copolymers such as ABS and butadiene-or isoprene-styrene copolymers, polyolefins and copolymers containing olefin units, and aminoplasts. Plasticizers, pigmentation, stains and/or fillers such as talc, carbon black, etc. commonly are employed in their recipes. The preferred retention components appear to be elastomeric, i.e., resilient. Many of them can be foamed and preferably are foamed only very slightly; this can soften them a bit without reducing their toughness too greatly and it can help to allow for some thermal expansion, and it makes them slightly less dense than without the foaming. Latent foaming agents reactive upon warming and/or catalyzing, incorporated in a film of an uncured polymer-providing material coated on a cover support are preferred. Curing with heat, ultraviolet or electron beam radiation and/or catalysis can be practiced.

Customarily, it is of advantage to prime the metal with a bonding agent or use a bonding treatment to secure the best bond of the retention component or a water sealing element to metal. Some polymers can bond well without this, e.g., epoxy resins. However, the bonds of most are improved by such priming and/or treating.

A preferred foamed plastisol formulation for the retention component is of Shore A Durometer hardness about 20–70, and preferably about 50–65, as are the water seals. The plastisol is compounded principally from low molecular weight polyvinyl chloride resin plasticized heavily with a conventional phthalate ester plasticizer. It contains minute percentages of stabilizer, red pigment and ozodicarbonamide blowing agent. Another preferred formulation of about the same Shore A Durometer hardness is a flexible polyol-polyurethane foam, slightly elastomeric and rubbery. Some polymer recipes need heat to cure and foam them, even with catalysis, and others cure and even foam at about room temperature (25° C.). The degree of foaming in both these plastisol and urethane formulations is very small, and it could be called almost microscopic and slight-the bubbles are closed-cell and tiny. In some cases, especially where sealing is to be maximized and strength considerations are secondary, a large degree of foaming and a resulting softened and less dense foamy structure can be tolerated, e.g., Shore A Durometer hardness of 20–55.

A recipe for a slightly-foamed polyurethane rubber that has been found to be quite effective here is as follows:

100 weight parts of Adiprene #L167 polyurethane, a product of the Uniroyal component of the F. G. Goodrich Company, Naugatuck, Conn.

Compounded with these additives:

0.3 weight part of water;

0.3 weight part of Dabco-33LV, a product of Air Products, Inc., Allentown, Pa.;

1.4 weight parts of DC-193, a product of Dow-Corning Inc., Midland, Mich.; and 16.0 weight parts of "BC", a product of Palmer, Sieka Inc., Port Washington, N.Y..

This material ca· be applied to warmed, cleansed and bonding agent-treated cast iron and steel, then heated to 121°–177° C. to develop the foam and full cure of the polymeric material.

Some preferred heat-curable plastisol retention component recipes for various Durometer hardness contain 100 parts of low molecular weight polyvinyl chloride resin plasticized with 60–70 parts of a conventional phthalate plasticizer such as dioctyl or dimethyl phthalate. With this 1–3 weight parts of a conventional stabilizer for polyvinyl chloride resin, e.g., a lead-based stabilizer, is used along with 1–2 weight parts of a red colorant (other pigments and colors, or none, can be used, if desired) and 0.5–3 weight parts of a conventional ozodicarbonamide heat-and water-activated blowing agent.

The preferred foamed plastisol usually is sprayed on the area to be coated. It is advantageous to spray it onto a hot metal cover support ring (188°–193° C.) and let it cure and foam a bit. If extra foaming and/or curing is desired, the coated part can be further warmed at 193°–204° C. for up to a few minutes.

The deformable retention component should be at least about a 0.1 mm. thick for most effective gripping to contact surfaces (which normally have irregularities). Preferably it should not be more than about 10–11 mm. thick for economy, general utility, and durability, although thicker retention components (or even portions of same) can be especially useful for sealing on some occasions. The same applies to cushioning components for cover seats, although these usually are at least about 1.2 mm. thick and easily can be as thick as 12 mm. or even more.

Metal surfaces should be cleaned to accept the polymeric material if it is to be bonded thereto. Then a customary bonding agent such as Chemlok #218 (Manufactured by Lord Corporation, Erie, Pa.) is applied, dried and warmed. Various other useful bonding agents are available such as a Pliobond type (made by the Goodyear Tire and Rubber Company).

As shown above, the preferred materials of construction for most of the cover support, i.e., the flange, extensions thereof and bases and various elements such as screws, are of a ferrous metal, e.g., steel such as rod, bar or sheet, and/or cast iron, particularly cast ductile iron for the rings. Other metals can be used where their special properties are desirable and their cost can be tolerated, e.g., stainless steel, high tensile strength steel, wrought iron, bronze, brass, etc. Also, suitable in some cases for various cover support parts, e.g. for much of the flange and base structures, are structures made from glass fiber-, aramid fiber-, or graphite fiber-reenforced resin, e.g., a thermosetting (curable) resin such as a polyester, polyamide or epoxy resins. Also highly filled polymers including elastomers, or ABS plastic and the like, i.e., tough structural polymeric materials can be used in the invention. In some instances, it is possible to fit a metal shape, e.g., a frame or armature such as a fixed diameter or an expansible steel hoop, to the inside part of a ring-like manhole cover support element. Such elements can then otherwise be almost entirely a tough, flexible polymeric, e.g. rubber-like material, optionally pigmented (filled) with, e.g., carbon black. Also, they may optionally be built up in plies with glass, nylon, cotton and/or steel cloth, wire and/or cords (like a truck tire carcass). In such instances, the outer part of the base can act as the retention component, although softer, elastomeric, polymer-containing coatings or films often can be used with advantage as special retention components laid over or bonded onto a harder polymer-containing substrate.

While an expandable base has been shown with four segments, it clearly can have more or less segments, or can even be a split ring with a single spreadable joint. In tests on broadly related manhole cover supports for use with a nominally 23-inch manhole, a split steel ring cover support had roughly double the grip in a steel retaining ring when coated with a heat-cured vinyl plastisol retention component as when uncoated to give steel-to-steel contact. Furthermore, the force needed to remove a broadly related four-segmented cover support of the same size from the same retaining ring was about 1.41 times that for the split ring one when both had the same kind of vinyl plastisol retention component on their outer walls and about the same retaining stress was exerted thereon.

The preferred type of turnbuckle spreader for the base is shown in the drawings. Of course, the more conventional turnbuckle with a central female member receiving a threaded bolt from each side, the bolts being threaded oppositely to each other, can be used. Also useful is simply a threaded bolt working against an inwardly-projecting bracket-like reaction piece as the spreader device, the bolt being threaded through an inwardly projecting opposing bracket and pressing the reaction piece away therefrom, thus enlarging the outer periphery of the base. While the peripheral flange has been illustrated as a one-piece unit, clearly it can be made of a plurality of joined sections, e.g. bolted together, if desired.

Modifications and variations of the invention will be apparent to those skilled in the art in the light of the foregoing detailed disclosure. Therefore, it is to be understood that, within the scope of the appended claims, the invention can be practiced otherwise than shown and described.

I claim:

1. A manhole cover support for raising the grade of an existing manhole cover-receiving structure having a cover keeper, the cover support comprising:

a peripheral flange including a seat for a manhole cover and a cover keeper extending upwardly from the outer periphery of the seat; and an expandable base that fits within the confines of the cover keeper of the existing manhole cover receiving structure, the base supporting the flange and being in rotationally slidable engagement therewith.

2. The cover support of claim 1 wherein the flange accommodates a circular manhole cover.

3. The cover support of claim 1 wherein the base has at least one adjustable joint equipped with spreader means capable of making the base fit tightly within the confines of the keeper of the existing manhole cover-receiving structure.

4. The cover support of claim 3 wherein the base and the inner periphery of the flange are essentially round, and the flange and base are connected by interfacing lugs and corresponding slots that are in essentially horizontal slidable engagement with respect to each other, a lug having a shoulder that is restrained by a surface of its corresponding slot from disengagement in a vertical direction from said corresponding slot.

5. The cover support of claim 3 wherein said seat is essentially flat.

6. The cover support of claim 3 wherein said seat is inclined.

7. The cover support of claim 1 wherein said existing cover-receiving structure is one of a group of existing manhole cover-receiving structures whose existing covers are geometrically similar but includes covers that differ in size, and the seat and keeper parts of the flange accommodate a manhole cover of a single size elected for the entire group.

8. A manhole cover support for raising the grade of an existing manhole cover-receiving structure for a round manhole cover, the manhole cover receiving structure having a keeper with an inner wall, the cover support comprising:

an expandable base ring that can be adjusted to make a snug fit within the inner wall of the existing receiving structure, the base ring having at least one adjustable joint equipped with a spreader; and a peripheral flange that is supported by the base ring and includes a cover seat and a cover keeper extending upwardly from the outer periphery of the seat, the base ring and flange being equipped with interfacing lugs and corresponding slots in a rotationally slidable engagement with each other that restrains the base ring and flange from a substantial vertical parting.

9. The manhole cover support of claim 8 wherein the base ring has the slots, and the flange has the lugs.

10. The manhole cover support of claim 9 wherein there is a single row of slots disposed around the base ring and a single row of lugs extending from the flange.

11. The manhole cover support of claim 10 wherein the lugs have downward-facing dove-tailed feet adapted for slidable engagement in corresponding slots of downward-facing dove-tailed configuration.

12. The manhole cover support of claim 9 wherein each lug has an enlarged foot, and there are a plurality of rows of slots disposed one above the other around the base ring for a selection of elevations, each slot in a row being accessible to and engageable by the foot of a corresponding lug extending down from the flange.

13. The manhole cover support of claim 11 wherein the lugs have downward-facing dove-tailed feet adapted for slidable engagement in corresponding slots of downward-facing dove-tailed configuration.

14. The manhole cover support of claim 8 wherein the base ring is divided into a plurality of segments with an adjustable joint between the opposing ends of each segment.

15. The manhole cover support of claim 8 wherein the spreaders are turnbuckle spreaders across the joints.

16. The manhole cover support of claim 8 wherein the base ring and the peripheral flange comprise ferrous metal.

17. The manhole cover support of claim 8 wherein there is a frictional retention component around at least part of the outside of the base ring.

18. The manhole cover support of claim 15 wherein a retention component is bonded to the outside of the base ring.

19. The manhole cover support of claim 16 wherein the retention component comprises a flexible polymer.

20. The manhole cover support of claim 17 wherein the retention component comprises an elastomer.

* * * * *